US008720413B2

(12) United States Patent
Song et al.

(10) Patent No.: US 8,720,413 B2
(45) Date of Patent: May 13, 2014

(54) VARIABLE COMPRESSION RATIO APPARATUS OF EXHAUST GAS BRAKE

(75) Inventors: Jin Ho Song, Anyang-si (KR); Sangchul Son, Hwasung-si (KR)

(73) Assignee: Hyundai Motor Company, Seoul (KR)

( * ) Notice: Subject to any disclaimer, the term of this patent is extended or adjusted under 35 U.S.C. 154(b) by 964 days.

(21) Appl. No.: 12/841,525

(22) Filed: Jul. 22, 2010

(65) Prior Publication Data

US 2011/0126800 A1 Jun. 2, 2011

(30) Foreign Application Priority Data

Dec. 2, 2009 (KR) ..... 10-2009-0118708

(51) Int. Cl.
*F02D 9/06* (2006.01)

(52) U.S. Cl.
USPC ..... 123/323; 123/48 A

(58) Field of Classification Search
USPC ..... 123/48 R, 48 A, 48 AA, 48 D, 320–323
See application file for complete search history.

(56) References Cited

U.S. PATENT DOCUMENTS

| | | | | |
|---|---|---|---|---|
| 3,889,646 | A * | 6/1975 | Harper et al. | 123/48 D |
| 4,860,711 | A * | 8/1989 | Morikawa | 123/48 D |
| 4,987,863 | A * | 1/1991 | Daly | 123/48 AA |
| 6,450,154 | B1 * | 9/2002 | Choi | 123/536 |
| 6,708,655 | B2 * | 3/2004 | Maloney et al. | 123/48 A |
| 7,438,025 | B2 * | 10/2008 | Yang | 123/27 R |
| 2003/0192490 | A1 * | 10/2003 | Maloney et al. | 123/48 A |
| 2007/0266990 | A1 * | 11/2007 | Sims | 123/321 |

* cited by examiner

*Primary Examiner* — Erick Solis
(74) *Attorney, Agent, or Firm* — Morgan, Lewis & Bockius LLP

(57) ABSTRACT

A variable compression ratio apparatus of an exhaust gas brake in an engine, may include a piston reciprocally moving in a cylinder of the engine, and an exhaust control valve that selectively communicates a combustion chamber of the cylinder with an exhaust manifold in accordance with pressure generated by the piston in the cylinder to control operating pressure of the piston.

9 Claims, 4 Drawing Sheets

VARIABLE COMPRESSION RATIO APPARATUS OF EXHAUST GAS BRAKE

CROSS-REFERENCE TO RELATED APPLICATION

The present application claims priority to Korean Patent Application No. 10-2009-0118708 filed in the Korean Intellectual Property Office on Dec. 2, 2009, the entire contents of which is incorporated herein for all purposes by this reference.

BACKGROUND OF THE INVENTION

1. Field of the Invention

The present invention relates to a variable compression ratio apparatus of an exhaust gas brake, and more particularly to a variable compression ratio apparatus of an exhaust gas brake that is capable of efficiently performing a brake operation.

2. Description of Related Art

Generally, because a full-sized vehicle, namely a truck or a bus, is very heavy due to its own weight or cargo, it is required to reduce a load of an engine brake so as to maintain stability thereof.

For this reason, a separate valve, i.e., a third valve, is further mounted at a plurality of cylinders having an intake valve and an exhaust valve, and the third valve is opened at nearly top dead center (TDC) of a piston when driving, and then compressed air in the cylinders is exhausted out of each cylinder.

Conventionally, the engine brake is classified as a jake brake and a bleed brake for exhausting exhaust gas out of the cylinders.

The jake brake indicates that an exhaust valve is temporarily opened at the late part of a compression stroke of a piston for offsetting compression pressure, and subsequently suppresses an inertial force for braking.

Further, the bleed brake indicates that the exhaust valve is continuously opened at the compression stroke of the piston, and thereby it performs the same function as that of the jake brake.

The conventional structure has an advantage of improving an engine brake performance by changing a cam profile of the cam shaft and exhausting compressed air out of the cylinders, however, the structure is complex and manufacturing cost is increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus of an exhaust gas brake having advantages of efficiently performing a brake operation.

In an aspect of the present invention, the variable compression ratio apparatus of an exhaust gas brake in an engine, may include a piston reciprocally moving in a cylinder of the engine, and an exhaust control valve that selectively communicates a combustion chamber of the cylinder with an exhaust manifold in accordance with pressure generated by the piston in the cylinder to control operating pressure of the piston.

The exhaust control valve may be selectively operated in accordance with operation of a brake pedal.

The exhaust control valve may include a valve body fixedly mounted in a mounting portion formed in a cylinder block, wherein the mounting portion is in a cylindrical hollow shape and a through hole formed at one side of the valve body is communicated to a through hole formed in the mounting portion, wherein the through hole of the mounting portion fluid-communicates with exhaust manifold, a slider slidably disposed in the valve body to selectively open the through hole of the valve body, and an adaptor that is fixed to one side of the slider and slidably moves with the slider in the valve body.

The slider may selectively move in the valve body by a hydraulic pressure supplied in the valve body by a solenoid valve disposed at one side of the valve body.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
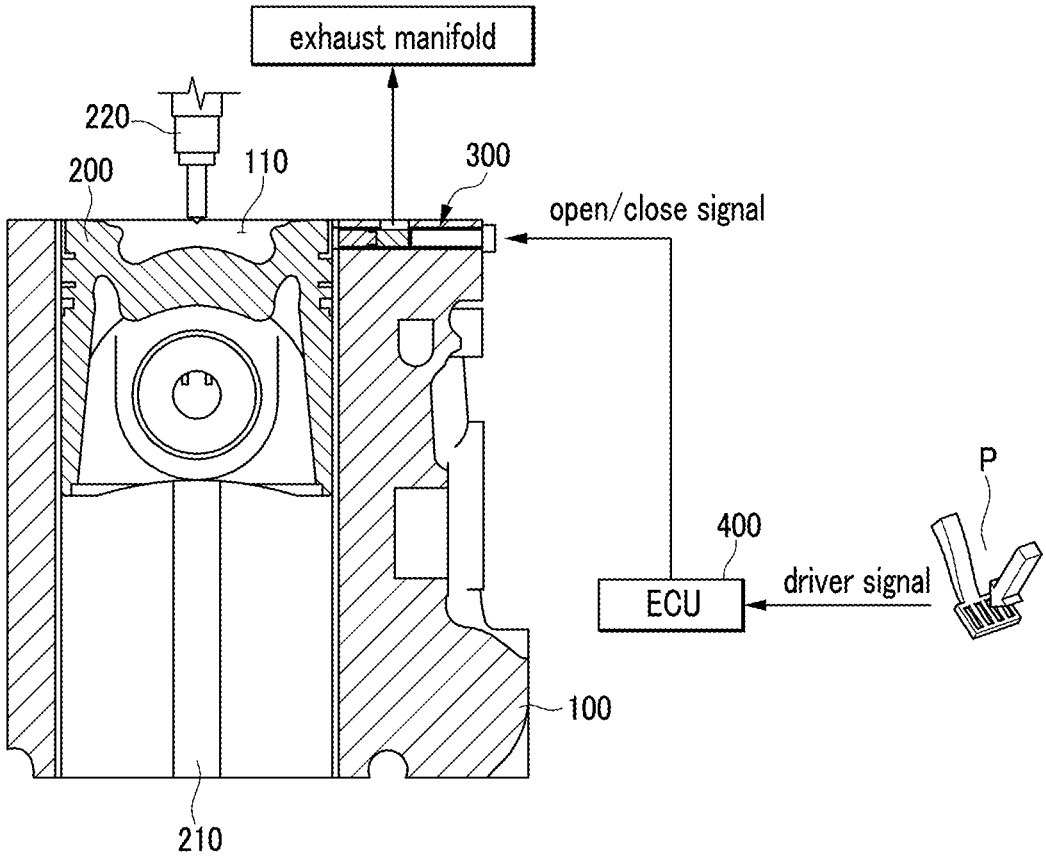
FIG. 1 shows a schematic view of an exemplary variable compression ratio apparatus of an exhaust gas brake according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 shows a schematic view of a variable compression ratio apparatus of an exhaust gas brake according to an exemplary embodiment of the present invention.

Figure 2:
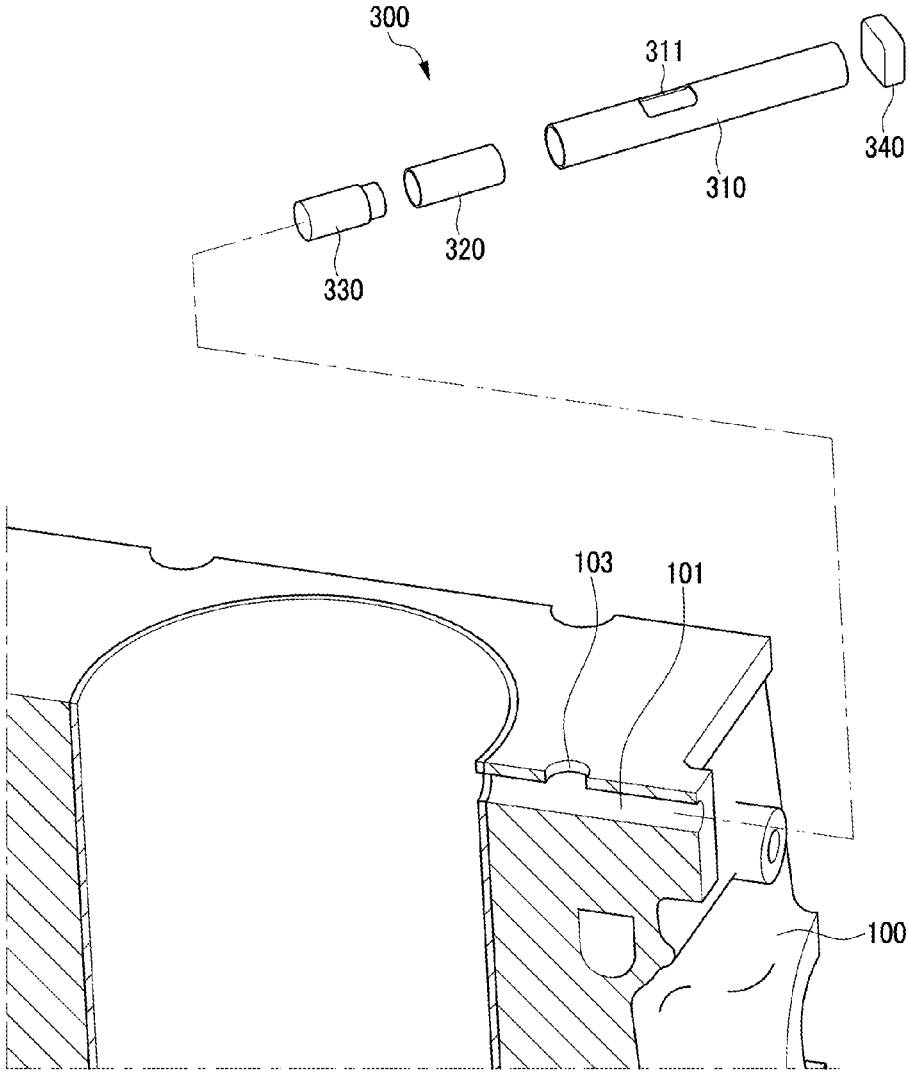
FIG. 2 shows an exploded perspective view of an exemplary variable compression ratio apparatus of an exhaust gas brake according to the present invention.

FIG. 2 shows an exploded perspective view of a variable compression ratio apparatus of an exhaust gas brake according to an exemplary embodiment of the present invention.

Figure 3:
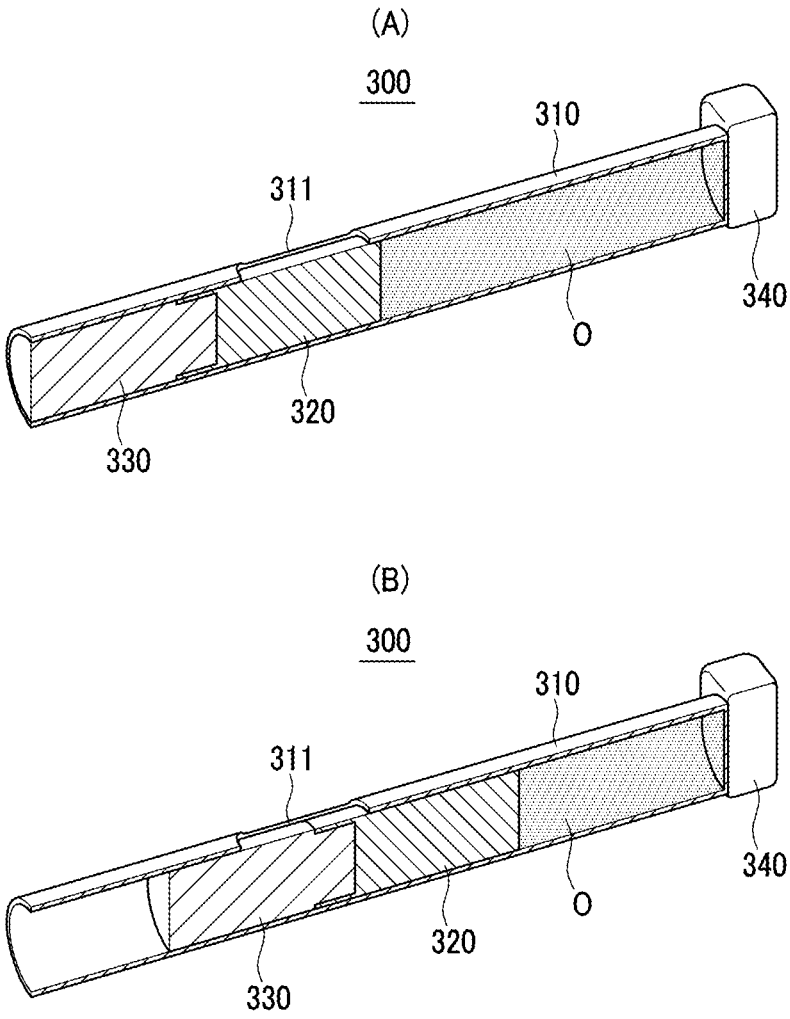
FIG. 3 shows an operating state of an exemplary variable compression ratio apparatus of an exhaust gas brake according to the present invention.

FIG. 3 shows an operating state of a variable compression ratio apparatus of an exhaust gas brake according to an exemplary embodiment of the present invention.

Figure 4:
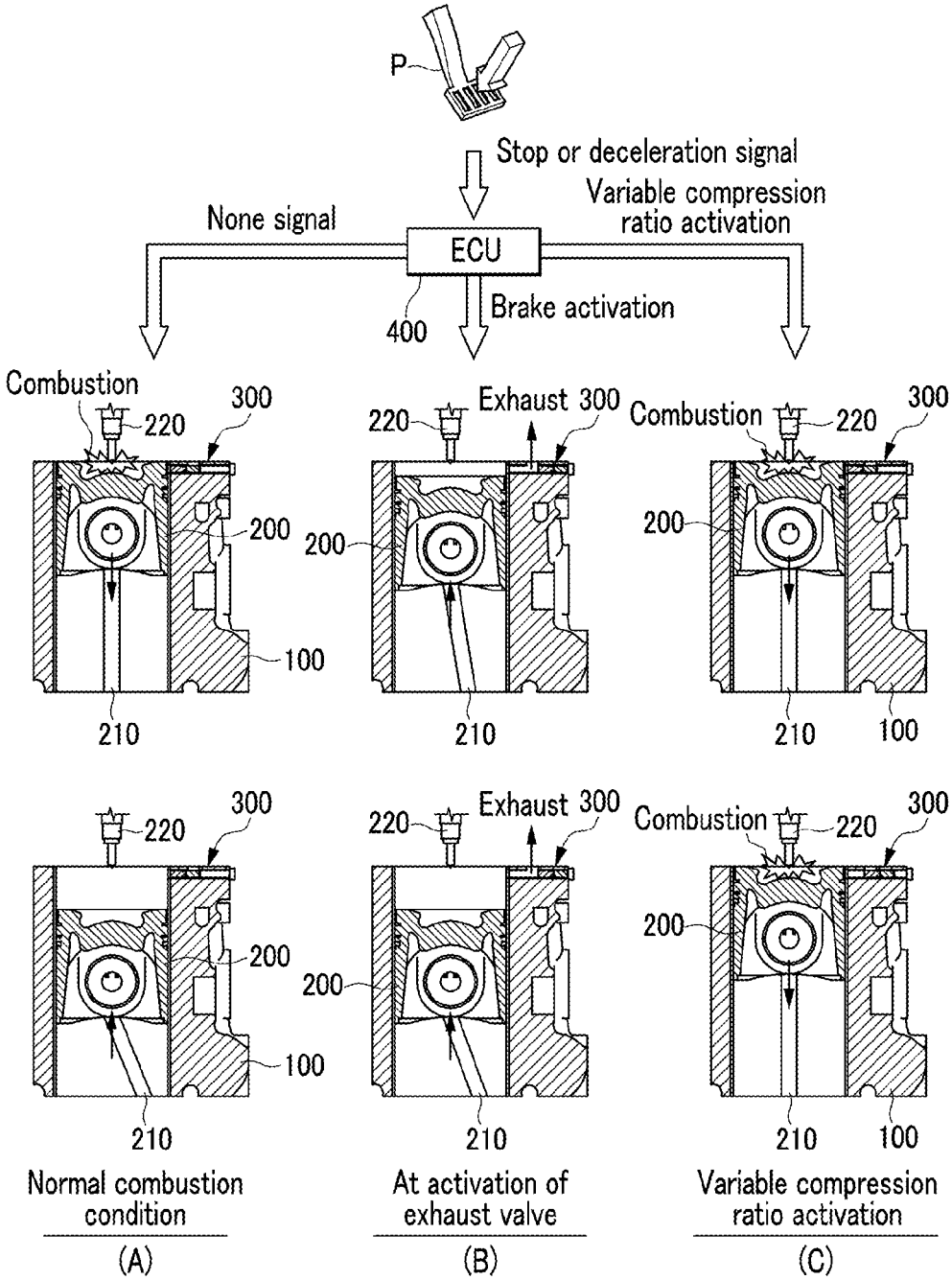
FIG. 4 shows an operating state of an exemplary variable compression ratio apparatus of an exhaust gas brake according to the present invention.

FIG. 4 shows an operating state of a variable compression ratio apparatus of an exhaust gas brake according to an exemplary embodiment of the present invention.

Herein, the engine may be employed in a conventional manner, some structures are not shown, and the engine will be described schematically as follows.

Conventionally, the engine includes a crankcase having a crank chamber, a cylinder block having a cylinder bore and a combustion chamber, and intake and exhaust ports.

A fuel tank may be disposed at a lower surface of the engine.

A cylinder head is integrally mounted at an upper portion of the cylinder block by bolts and the like so that a combustion chamber is formed therebetween, and a crankcase is formed at a lower side of the cylinder block.

The crankcase is divided in half, and the halves are joined together by bolts.

A crankshaft disposed in the crank chamber is rotated by ball bearings, and the crankshaft is connected to the piston through a connecting rod 210.

Further, an oil seal is mounted at the bearing and closely contacts the exterior circumference of the crankshaft so as to completely seal, and further a gasket may be interposed between a connecting portion of the cylinder block and the crankcase.

Further, an exhaust manifold is formed at the cylinder head so as to be extended outwardly therefrom.

The exhaust manifold excretes exhaust gas.

In addition, the engine is uniformly divided forwardly and rearwardly.

At this time, the frontal portion of the engine includes an exhaust system, and the rearward portion includes an intake system.

An injector 220 is mounted at the cylinder head and approximately faces a central portion of the combustion chamber, and at least two intake valves and at least two exhaust valves are provided.

The intake valves and the exhaust valves opening and closing an intake port and an exhaust port are mounted at the cylinder head so as to be parallel with respect to an axial direction of a cylinder bore.

Referring to FIG. 1 to FIG. 4, a variable compression ratio apparatus of an exhaust gas brake as mentioned above will hereinafter be described in detail.

As shown in FIG. 1, the variable compression ratio apparatus of an exhaust gas brake according to an exemplary embodiment of the present invention includes a cylinder block 100, a piston 200 that is reciprocally operated by a drive device such as a crankshaft (not shown) and is disposed at a connecting rod 210 connected to the crankshaft, a combustion chamber 110 formed between the cylinder head (not shown) and the piston 200, an exhaust control valve 300, and an ECU 400 for controlling the exhaust control valve 300 based on a force of a brake pedal P operated by driver.

A water jacket (not shown) is formed at a wall of the cylinder block 100 for cooling.

The water jacket is communicated to another water jacket formed at the cylinder head.

In addition, an exhaust control valve 300 is mounted at each of the cylinders or at a specific cylinder, and a through hole 103 that is opened or closed by the exhaust control valve is communicated to the exhaust manifold at the cylinder head.

As shown in FIG. 2, a mounting portion 101 is formed at one side of the exhaust control valve 300, and the exhaust control valve 300 is mounted at the mounting portion.

The exhaust control valve 300 includes a valve body 310, an adaptor 320, and a slider 330.

The valve body 310 is formed with a cylindrical shape, and is fixedly inserted into the mounting portion 101.

Additionally, a through hole 311 is formed at one side of the valve body 310, and is communicated to the exhaust manifold.

The slider 330 is fixedly mounted at one end of the adaptor 320, and the slider 330 is reciprocally disposed inside the valve body 310.

Thus, the slider 330 is connected to the valve body 310 through the adaptor 320. The through hole 311 is disposed at a place where the through hole 311 can communicate with the through hole 103 of the mounting portion 101.

A solenoid valve 340 can be mounted at one end of the valve body 310.

The solenoid valve 340 supports the valve body 310 from pressure generated in the explosion and expansion stroke of the piston with hydraulic pressure of operating media "O" such as oil supplied by the solenoid valve 340.

Therefore, the solenoid valve 340 supports the valve body 310 with hydraulic pressure of the operating media "O" during a reciprocal motion of the piston along an inner wall of the cylinder block 100, while the pressure of the inside of the combustion chamber is increased due to an increase in height of the piston 200.

Herein, when a driver sends a stop signal to the ECU by pushing a brake pedal P, the ECU controls the solenoid valve 340 according to the stop signal.

Further, the slider 330 is selectively reciprocally moved by the operating media "O" in the solenoid valve 340 in a direction thereof.

At this time, an air or hydraulic pressure cylinder instead of the solenoid valve can be provided for controlling the electric valve of a pressure supply circuit according to an electrical signal of an exhaust brake operation switch.

The exhaust brake is operated as described above, the ECU receives the same signal, and as shown in (A) and (B) of FIG. 3, the slider 330 is moved back and forth so as to open or close the through hole 103 with the solenoid valve 340.

In this way, an inner volume compressed by the piston 200 operated by the slider 330 is variable, so a compression ratio of the piston 200 is variable.

More specifically, in case of normal combustion condition, as shown in FIG. 4, the through hole 103 is opened or closed in a state that hydraulic pressure of the solenoid valve 340 is exerted on the slider 330, then pressure caused by the piston 200 in the cylinder is shown as a normal compression ratio.

Further, as shown in (B) of FIG. 4, the pressure of the solenoid valve 340 is released at the exhaust stroke, so the exhaust gas is exhausted through the through hole 103.

In this way, when the driver's deceleration signal is received, variable compression ratios are possible.

Therefore, as shown in (C) of FIG. 4, when the piston 200 reaches top dead center (TDC) during compression by the piston 200, hydraulic pressure of the solenoid valve 340 is released and simultaneously the through hole 103 is opened, and then the inner volume of the cylinder is increased.

At this time, the compression ratio of the piston 200 becomes the least.

As can be seen from the foregoing, the variable compression ratio apparatus of an exhaust gas brake according to an exemplary embodiment of the present invention has advantages of simplifying an exhaust brake apparatus applied to a bus or a truck, and improving brake performance by controlling a compression volume.

For convenience in explanation and accurate definition in the appended claims, the terms "upper" and "inner" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus of an exhaust gas brake that controls an operating pressure of a piston at about top dead center through an exhaust control valve, comprising:

a connecting rod reciprocally moving to turn a crankshaft for each cylinder of an engine;

the piston that operates the connecting rod and generates power; and the exhaust control valve that is opened or closed based on pressure generated by the piston, wherein the exhaust control valve controls operating pressure of the piston with hydraulic pressure selectively supplied to the exhaust control valve.

2. The apparatus of claim 1, wherein the exhaust control valve further comprises:

a valve body mounted at one side of a cylinder block and having a cylindrical shape;

a through hole that is formed at one side of the valve body and that is communicated to an exhaust manifold of the engine;

a slider slidably disposed inside the valve body and selectively opening the through hole of the valve body; and an adaptor that is mounted at the slider and slidably moves inside the valve body with the slider integrally.

3. The apparatus of claim 2, wherein the valve body is mounted in a mounting portion formed at one side of the cylinder block with a cylindrical shape.

4. The apparatus of claim 2, wherein the exhaust control valve is operated by a solenoid valve disposed at one side of the valve body to control the hydraulic pressure.

5. A variable compression ratio apparatus of an exhaust gas brake that controls an operating pressure of a piston at about top dead center through an exhaust control valve, comprising:

a connecting rod reciprocally moving to turn a crankshaft for each cylinder of an engine;

the piston that operates the connecting rod and generates a power;

a mounting portion, one end of which is fluid-communicated to a combustion chamber of the cylinder and the other end of which is fluid-communicated to an exhaust manifold, wherein the mounting portion is formed at one side of a cylinder block with a hollow-cylindrical shape; and the exhaust control valve that is mounted in the mounting portion, and controls exhaust gas generated in the cylinder when driving to be communicated with or blocked from the exhaust manifold;

wherein the exhaust control valve is operated by a solenoid valve disposed at one side thereof.

6. The apparatus of claim 5, wherein the exhaust control valve further comprises:

a valve body formed at one side of the cylinder block with a cylindrical shape;

a through hole that is formed at one side of the valve body and that is communicated to the exhaust manifold of the engine;

a slider slidably disposed inside the valve body; and an adaptor that is mounted at the slider and that slidably moves inside the valve body with the slider integrally.

7. A variable compression ratio apparatus of an exhaust gas brake in an engine, comprising:

a piston reciprocally moving in a cylinder of the engine; and an exhaust control valve that selectively communicates a combustion chamber of the cylinder with an exhaust manifold in accordance with pressure generated by the piston in the cylinder to control operating pressure of the piston:

wherein the exhaust control valve is selectively operated in accordance with operation of a brake pedal.

8. The apparatus of claim 7, wherein the exhaust control valve comprises:

a valve body fixedly mounted in a mounting portion formed in a cylinder block, wherein the mounting portion is in a cylindrical hollow shape and a through hole formed at one side of the valve body is communicated to a through hole formed in the mounting portion, wherein the through hole of the mounting portion fluid-communicates with exhaust manifold;

a slider slidably disposed in the valve body to selectively open the through hole of the valve body; and an adaptor that is fixed to one side of the slider and slidably moves with the slider in the valve body.

9. The apparatus of claim 8, wherein the slider selectively moves in the valve body by a hydraulic pressure supplied in the valve body by a solenoid valve disposed at one side of the valve body.

* * * * *